United States Patent [19]

Daniels

[11] Patent Number: 5,075,897

[45] Date of Patent: Dec. 31, 1991

[54] MULTI-PURPOSE PROTECTIVE GARMENT

[76] Inventor: Victory A. Daniels, 427, Nevada City, Calif. 95959

[21] Appl. No.: 426,583

[22] Filed: Oct. 23, 1989

[51] Int. Cl.[5] ..... A41B 13/10

[52] U.S. Cl. ..... 2/2; 2/49 A; 108/43

[58] Field of Search ..... 190/1; 2/48, 46, 49 R, 2/49 A, 2, 51; 383/4; 446/27; 108/43

[56] References Cited

U.S. PATENT DOCUMENTS

| | | | |
|---|---|---|---|
| 954,840 | 4/1910 | Wiedemann | 383/4 X |
| 1,108,557 | 8/1914 | Dudley | 2/49 R |
| 1,970,307 | 8/1934 | Hartmann | 2/48 |
| 2,265,690 | 12/1941 | Fiedler | 2/49 R |
| 2,270,598 | 1/1942 | Morgan | 383/4 |
| 3,143,748 | 8/1964 | Manning | 383/4 |
| 3,418,746 | 12/1968 | Kharasch | 446/27 |
| 3,489,194 | 1/1970 | Hoover | 383/4 |
| 3,871,027 | 3/1975 | Orr | 2/49 R |
| 4,514,870 | 5/1985 | Tyler, Jr. | 2/49 A X |
| 4,546,492 | 10/1985 | Dickenson | 2/46 |
| 4,660,224 | 4/1987 | Ashcraft | 2/48 |
| 4,723,300 | 2/1988 | Aranow | 383/4 |
| 4,733,411 | 3/1988 | Foti | 2/49 R |
| 4,754,500 | 7/1988 | Brucato | 2/105 |
| 4,779,288 | 10/1988 | Mack | 2/49 R |
| 4,780,911 | 11/1988 | Mack | 2/49 R |

FOREIGN PATENT DOCUMENTS

| | | | |
|---|---|---|---|
| 2458258 | 2/1981 | France | 108/43 |
| 1264919 | 2/1972 | United Kingdom | 383/4 |

*Primary Examiner*—Werner H. Schroeder
*Assistant Examiner*—Sara M. Current

[57] ABSTRACT

A multi-purpose garment comprised of an absorbent textile material. The garment being intended to protect the lap and chest while commuting as well as having additional utility. The garment will be worn by a strap from the neck and will prevent spills and stains from clothing worn while commuting.

1 Claim, 2 Drawing Sheets

MULTI-PURPOSE PROTECTIVE GARMENT

TECHNICAL FIELD

This invention relates to the protection of outer garments worn while commuting in various forms of motorised transportation. The protective garment provides both protection as well as various ramification illustrated in this patent.

PRIOR ART

The prior art research has clearly shown a number of examples of protective outer garments.

U.S. Pat. Nos. 4,780,911 and 4,779,288 Robert J. Mack. Show water-proof sheet material and a collective pocket used with a disposable infant bibs.

U.S. Pat. No. 4,754,500 Norma J. Brucato. Shows a special garment for disabled and infirm. The garment provides a overlay which is removable providing a protective covering.

U.S. Pat. No. 4,733,411 Cynthia S. Foti. Shows a disposable bib having an outer absorbent paper layer and inner waterproof plastic layer.

U.S. Pat. No. 4,546,492 Alfred J. Dickenson. Shows a flexible sheet material overlapping and parallel to surface of protected garment having a plurality of layers.

U.S. Pat. No. 3,871,027 Byron Reid Orr. Shows a protective pad to protect while burping baby or, alternatively, to use as a bib. The above means is held in place with adhesive strips and is disposable.

The above prior art provides a number of methods to protect outer garments. These innovative methods cover the time span from birth to death.

SUMMARY OF INVENTION

This invention relates to a protective garment being made from a textile material suitable for this application. The material will be both absorbent and flexible so as to comform to service covered. The shape of the invention may change to some degree but will remain in the framework of its purpose.

The major use of this invention will be used when commuting on the various forms of transportation. While many of us have grown accustomed to eating on the run, no one has provided a multi-purpose protective garment to prevent spots and stains on our clothing during these commutes.

The invention includes two main parts. One being a lap covering having an area large enough to provide protective coverage over the entire lap. The second being a chest protective covering having an area such to cover the entire chest area.

These two main parts are connected by a folding seam stitched at or near the torso lower end when in a sitting position. The invention is held in place by the means of a neck strap. The neck strap is made from a suitable material and is attached to the upper portion of the protective chest covering. The neck strap being of length to circumference the neck with comfort and may be adjusted by means of VEL-CRO, snaps or tied. The above two main portions are made from a suitable fabric material being comprised of layers stitched together and bordered in tradional methods.

The above portions having various combinations of VEL-CRO, snaps and loops will enable the invention additional utility. Having the invention folded in half the protective garment creates a seat cushion. When the invention is laid open and flat it creates a safe comfortable area to change an infant on. The inventions folded and fastened together and carried by the neck strap will create a tote bag. The multi-purpose garment worn while standing up will become an apron suitable for both indoor and outdoor use.

DESCRIPTION OF THE PREFERRED EMBODIMENTS

The preferred embodiments, herein described, are not intended to limit the invention in any form or possible use. The embodiments are described to show and explain the practical use of this invention.

Figure 1:
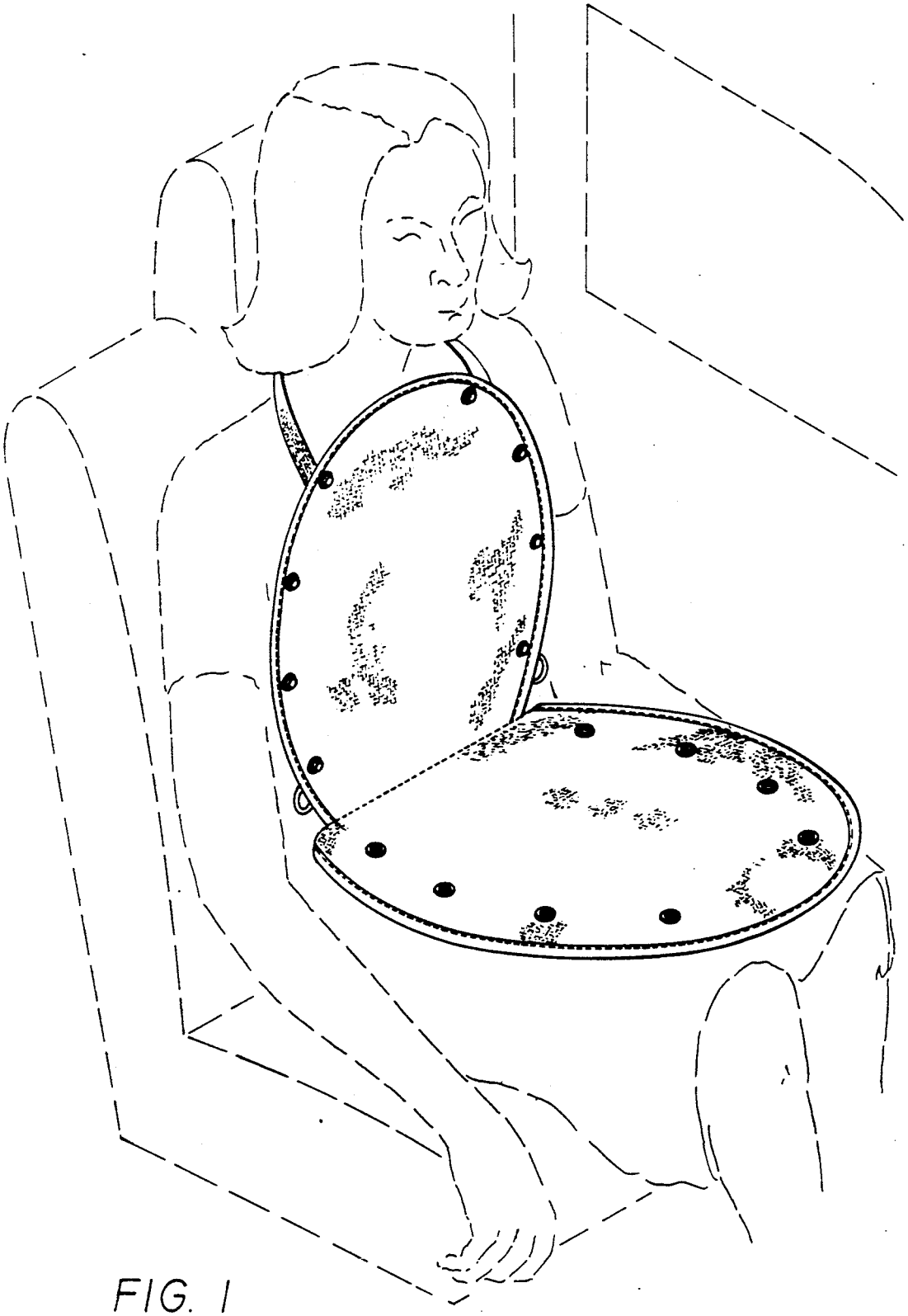
FIG. 1 Illustrates a person commuting, wearing the invention as a protective garment.

Referring now to the drawing, FIG. 1, this drawing demonstrates a commuter wearing the invention.

Figure 2:
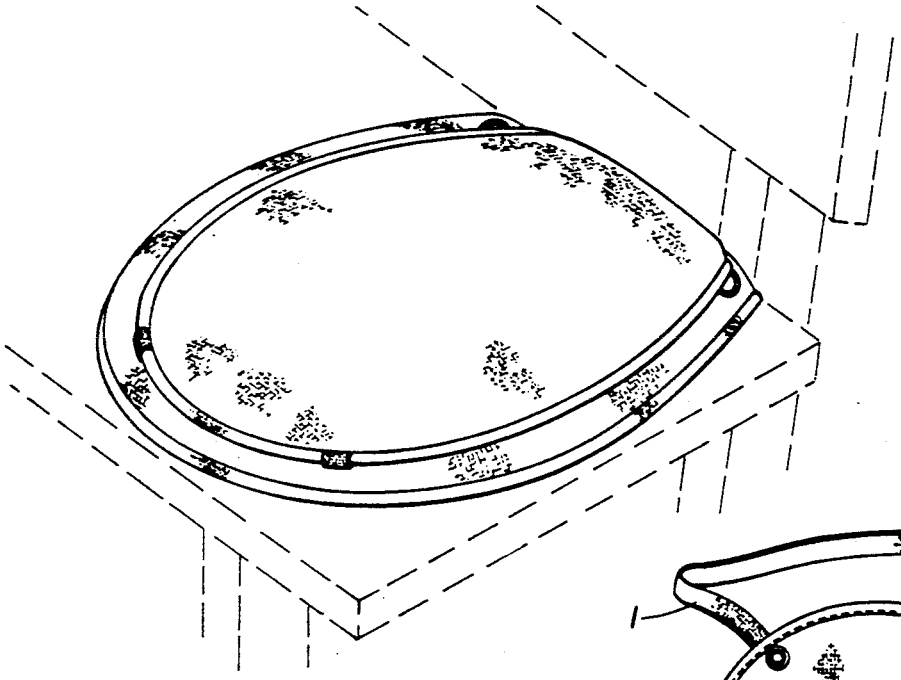
FIG. 2 Illustrates the invention folded in half with the upper portion snapped to lower, being used as an extra cushion.

Referring to drawing, FIG. 2, shows the invention folded in half and placed on a seat as a cushion.

Figure 3:
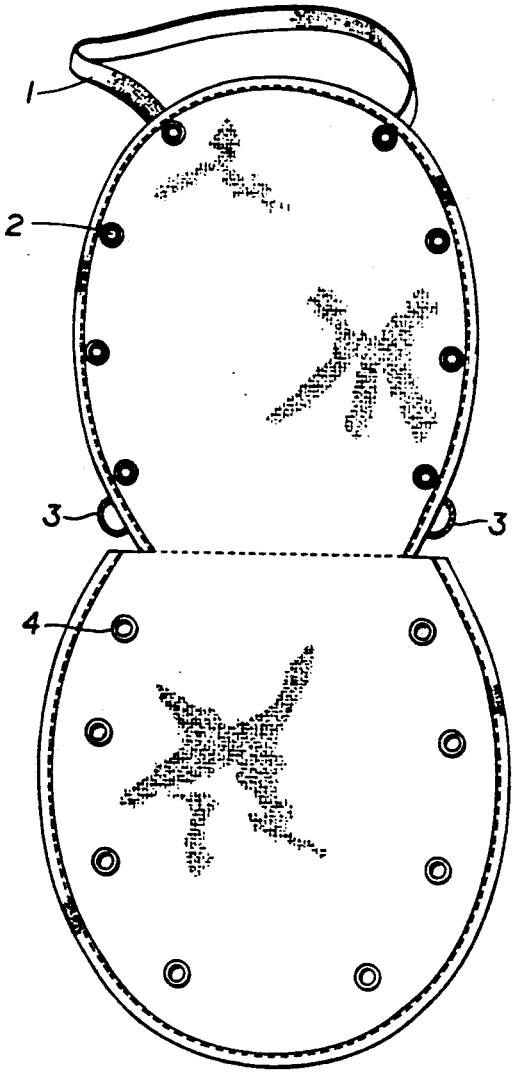
FIG. 3 Illustrates the multi-purpose protective garment opened into a full cushion, so to cushion both seat and back.

Referring to the illustrated drawing, FIG. 3, the invention is open.

Reference 1 clearly illustrates the neck strap.

Reference 2 and 4 show show male and female snaps respectfully.

Reference 3 shows the location of loops used for waist fastening.

Figure 4:
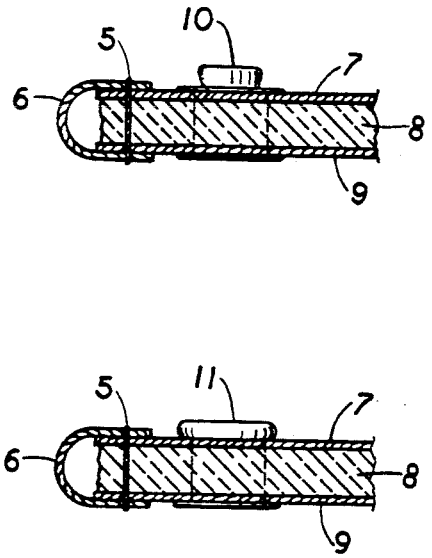
FIG. 4 Illustrates the stitching of the seam binding as well as the male and female snaps. It also shows the layers of fabric.

Referring to FIG. 4, illustrates the construction of materials used in said invention.

Reference 5 illustrates the stitching of the seam binding 6, and fabric materials 7 and 9 as well as the filler material 8.

Reference 10 illustrates a male snap, with 11 illustrating a female snap, which allows the invention to be snapped together shown in FIG. 2.

I claim:

1. A multi-purpose protective garment for protecting a person from stains and spills when consuming food and beverages comprising:

a two part covering comprising a first torso covering part and a second lap covering part, each part made in an elliptical shape having a straight edge at one end thereof, the surface area of said first torso covering part being smaller than the surface area of said second lap covering part;

each of said first and second parts consisting of absorbent fabric layers having a filler material sandwiched therebetween to form a cushion;

means for hingedly connecting the straight edges of said first and second parts together;

attachment means at the peripheries of said elliptically shaped parts to selectively connect the parts together in a face-to-face relationship;

a neckstrap connected to the elliptical apex of said first torso covering part, whereby when said neckstrap is placed around the neck of a wearer, the first part will cover the wearer's torso and the second part will cover the wearer's lap when the wearer is in a sitting position, and when said attachment means are connected together, the protective garment can be used as a cushion.

* * * * *